US008193445B2

(12) United States Patent
Li

(10) Patent No.: US 8,193,445 B2
(45) Date of Patent: Jun. 5, 2012

(54) TAMPER RESISTANT POWER RECEPTACLE HAVING A SAFETY SHUTTER

(75) Inventor: Cheng-li Li, Shanghai (CN)

(73) Assignee: Bingham McCutchen LLP, Washington, DC (US)

( * ) Notice: Subject to any disclaimer, the term of this patent is extended or adjusted under 35 U.S.C. 154(b) by 357 days.

(21) Appl. No.: 12/412,667

(22) Filed: Mar. 27, 2009

(65) Prior Publication Data

US 2009/0236115 A1 Sep. 24, 2009

(51) Int. Cl.
*H01R 13/46* (2006.01)

(52) U.S. Cl. ..... 174/53; 174/50; 174/57; 174/58

(58) Field of Classification Search ..... 174/50, 174/53, 57, 58, 66, 67; 439/135–137, 140, 439/143; 361/42
See application file for complete search history.

(56) References Cited

U.S. PATENT DOCUMENTS

| | | | | |
|---|---|---|---|---|
| 4,271,337 | A | 6/1981 | Barkas | |
| 4,379,607 | A | 4/1983 | Bowden, Jr. | |
| 4,544,219 | A | 10/1985 | Barkas | |
| 4,722,693 | A | 2/1988 | Rose | |
| 4,749,360 | A | 6/1988 | Dudley et al. | |
| 4,822,290 | A | 4/1989 | Cauley et al. | |
| 4,867,694 | A | 9/1989 | Short | |
| 5,006,075 | A | 4/1991 | Bowden, Jr. | |
| 5,020,997 | A * | 6/1991 | Calderara et al. | 439/137 |
| 5,915,981 | A | 6/1999 | Mehta | |
| 6,149,446 | A | 11/2000 | Yu | |
| 6,238,224 | B1 | 5/2001 | Shao | |
| 6,555,771 | B2 * | 4/2003 | Shao | 200/51 R |
| 6,749,449 | B2 | 6/2004 | Mortun et al. | |
| 6,893,275 | B2 | 5/2005 | Ng et al. | |
| 7,179,992 | B1 | 2/2007 | Packard et al. | |
| 7,312,394 | B1 | 12/2007 | Weeks et al. | |
| 7,312,963 | B1 | 12/2007 | Radosavljevic et al. | |
| 7,355,117 | B2 | 4/2008 | Castaldo et al. | |
| 7,588,447 | B1 * | 9/2009 | Ni | 439/137 |
| 2002/0048987 | A1 | 4/2002 | Ursich | |
| 2003/0045145 | A1 | 3/2003 | Mortun et al. | |
| 2007/0114053 | A1 * | 5/2007 | Castaldo et al. | 174/53 |
| 2007/0211397 | A1 | 9/2007 | Sokolow et al. | |

* cited by examiner

*Primary Examiner* — Quyen Leung
*Assistant Examiner* — Jose Gonzalez Quinones
(74) *Attorney, Agent, or Firm* — Bingham McCutchen LLP

(57) ABSTRACT

A safety shutter for a power receptacle includes two identical sliding blocks engaged with each other and two biasing members. Each sliding block has a base and a platform extending from the base with a slanted surface. The slanted surfaces are disposed below the holes of the receptacle. The biasing members are helical torsion springs disposed at the end of the sliding blocks. The platform of each sliding block is disposed above the base of the other sliding block so the shutter normally blocks access to the conductors inside the receptacle. When two prongs of a plug are inserted into both holes, the prongs push on both slanted surfaces, causing the shutter to open. When a foreign object is inserted into only one hole, only one sliding block is moved by the foreign object and the base of the other sliding block still blocks access to the conductors.

8 Claims, 9 Drawing Sheets

TAMPER RESISTANT POWER RECEPTACLE HAVING A SAFETY SHUTTER

BACKGROUND OF THE INVENTION

1. Field of the Invention

This invention relates to a power receptacle, and in particular, it relates to a receptacle with a safety shutter providing tamper resistance.

2. Description of the Related Art

Conventional power receptacle such as wall receptacles or extension cord receptacles have one or more holes to receive plugs. The electrical conductors in open holes may corrode due to the moisture in the air, or their electrical conductivity may be affected by dust accumulation. Moreover, if used improperly, or if children play with the receptacle, conductive foreign objects may be inserted into the hole. This can cause electrical shock and is of great safety concern.

To solve the above problem, tamper resistant receptacles have been developed. However, these tamper resistant receptacles have various shortcomings.

For example, in the tamper resistant receptacle described in U.S. Pat. No. 4,379,607, a plastic biasing member is used at each end of the device to urge the shutter to the closed position. Such plastic biasing members tend to be unreliable as the material may become fatigued due to repeated use and various environmental factors. Thus, the elasticity of the plastic material may be lost and the shutters may fail to close. Further, the plastic biasing members are bulky and increase the overall size of the receptacle.

As another example, in the tamper resistant receptacle described in U.S. Pat. No. 5,915,981, a coaxially disposed compression coil spring is used at each end of the device to urge the shutter to the closed position. Such springs also tend to be bulky.

As another example, in the tamper resistant receptacle described in Chinese patent CN 99254384.3, the biasing member used in the safety mechanism is an F-shaped metal plate, which tends to become fatigued or broken due to repeated use. Further, the biasing member and the safety mechanism are installed separately, making it inconvenient to install and replace and limiting its applicability.

Some other tamper resistant receptacles have complicate structures and are costly to manufacture.

SUMMARY OF THE INVENTION

The present invention is directed to an improved tamper resistant power receptacle.

An object of the present invention is to provide a tamper resistant power receptacle that is reliable and compact and has wide applicability.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a safety shutter for a power receptacle, which includes: two identical sliding blocks engaged with each other, wherein each sliding block includes a base having an opening and a platform extending upward and outward from a first end of the base, the platform having an outward-facing slanted surface and a rear surface opposite the slanted surface, wherein the rear surfaces of the two platforms face each other, wherein the platform of each sliding block is disposed above an upper surface of the base of the other sliding block, and wherein each sliding block has a blocking portion extending from the base to contact against the slanted surface of the other sliding block when the two sliding blocks move relative to each other in a first direction; and two helical torsion springs, one for each sliding block, wherein each helical torsion spring is disposed at a second end of the corresponding sliding block to urge the two sliding blocks to move relative to each other in the first direction.

In another aspect, the present invention provides a tamper resistant power receptacle, which includes: a cover having at least two holes; a base coupled to the cover, the base including a plurality of conductors corresponding in position with the holes of the cover; and a safety shutter which includes: two identical sliding blocks engaged with each other, wherein each sliding block includes a base having an opening and a platform extending upward and outward from a first end of the base, the platform having an outward-facing slanted surface and a rear surface opposite the slanted surface, wherein the rear surfaces of the two platforms face each other, wherein the platform of each sliding block is disposed above an upper surface of the base of the other sliding block, and wherein each sliding block has a blocking portion extending from the base to contact against the slanted surface of the other sliding block when the two sliding blocks move relative to each other in a first direction, and wherein the slanted surfaces of the two sliding blocks are disposed below the two holes of the cover; and two helical torsion springs, one for each sliding block, wherein each helical torsion spring is disposed at a second end of the corresponding sliding block to urge the two sliding blocks to move relative to each other in the first direction.

It is to be understood that both the foregoing general description and the following detailed description are exemplary and explanatory and are intended to provide further explanation of the invention as claimed.

BRIEF DESCRIPTION OF THE DRAWINGS

The features and advantages of the preferred embodiments can be further understood from the detailed description below with reference to the following drawings:

FIGS. 2*a*-2*c* are perspective views of various components of the safety shutters of FIG. 1, wherein FIG. 2*a* shows a single sliding shutter block and its biasing member, FIG. 2*b* shows two sliding shutter blocks and their biasing members in an assembled stated, and FIG. 2*c* shows the two sliding shutter blocks and their biasing members in a state when a foreign object is inserted.

FIG. 5*b* is a cross-sectional view along the line X-X of FIG. 5*a*.

DETAILED DESCRIPTION OF THE PREFERRED EMBODIMENTS

Figure 1:
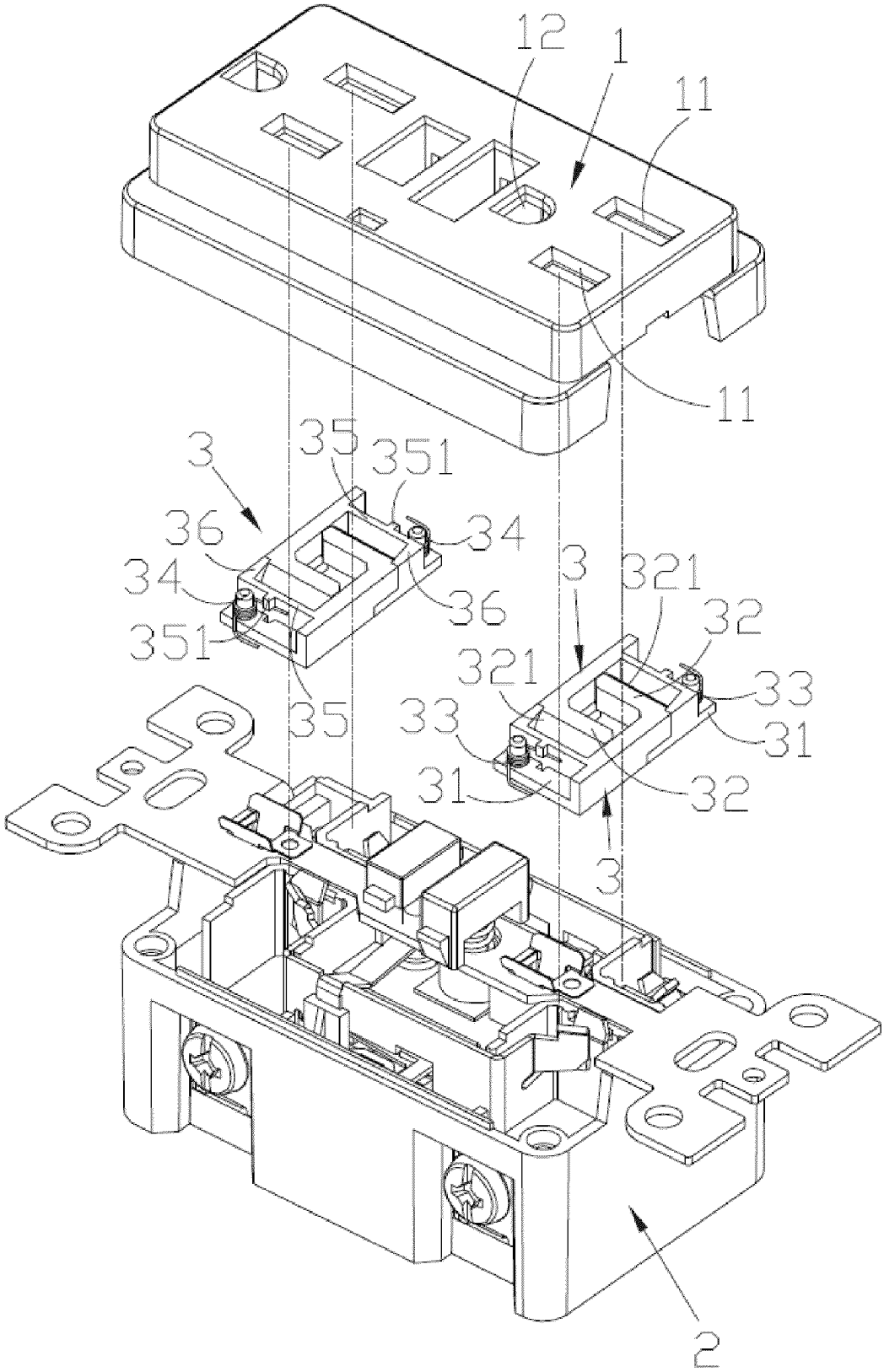
FIG. 1 is a partial exploded perspective view of a tamper resistant power receptacle showing the safety shutters according to an embodiment of the present invention.

In the drawings and the descriptions below, similar components of the embodiments are labeled with similar or the same reference symbols. In addition, the sliding mechanism is formed by two identically shaped sliding blocks cooperating with each other, and in some figures reference symbols are provided for one of the sliding blocks.

Referring to FIG. 1, a tamper resistant receptacle incorporating a safety shutter according to embodiments of the present invention includes a cover 1 and a base 2 removably coupled to the cover. The cover 1 has hot and neutral holes 11 and a ground hole 12. The base 2 includes hot and neutral conductors 21 and ground conductors 22 corresponding to the hot and neutral holes 11 and the ground hole 12. The safety shutter is disposed between the cover 1 and the base 2, preferably aligned with the hot and neutral holes 11. The safety shutter includes two identically shaped sliding blocks 3 and corresponding biasing member.

Figure 2A:
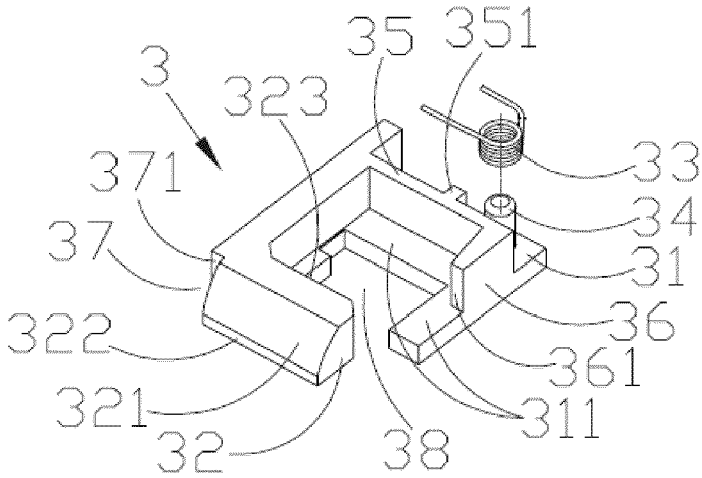
Figure 2B:
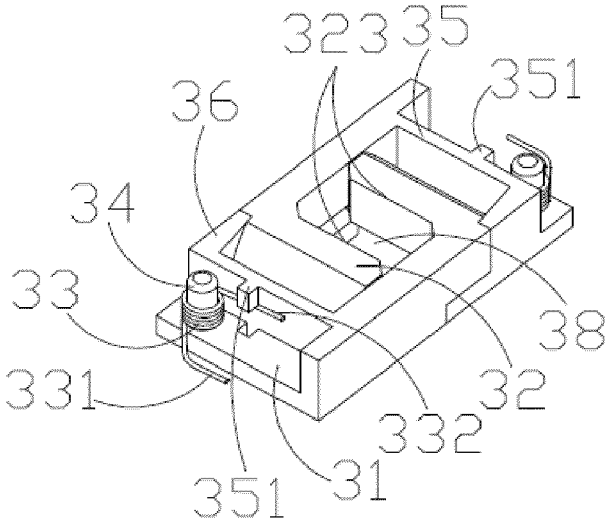
Figure 2C:
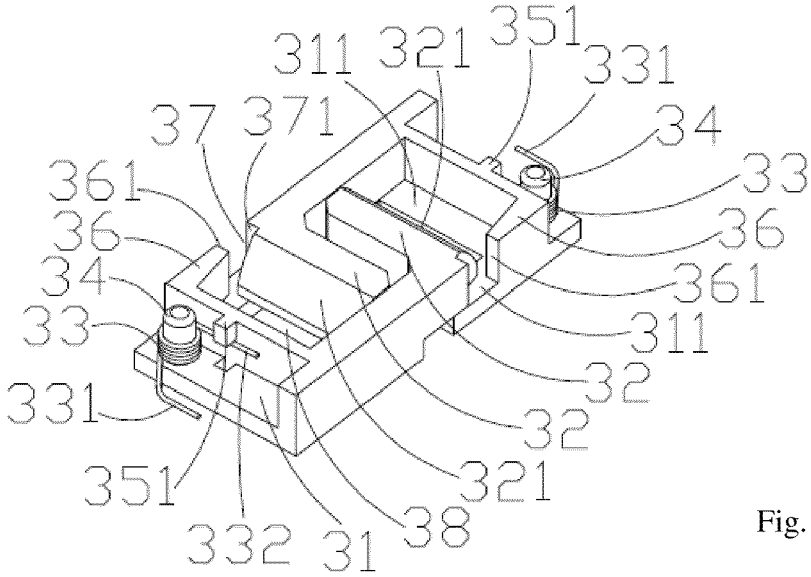

FIGS. 2*a*-2*c* show the detailed structure of the safety shutter including the sliding blocks and the biasing members. As shown in FIG. 2*a*, the sliding block 3 includes a base 31 having an opening 38. The opening 38 can have any suitable shape as long as it sufficiently exposes the conductor 21 of the base 2 so that the plug can go through the opening to contact the conductor 21 in a normal connection. At one end of the base 31, a platform 32 extends upward and outward from the upper surface of the base 31, the platform 32 having a slanted surface 321 facing upward and outward to form a wedge shape. When an object is inserted into the corresponding hole of the receptacle, the object moves downward along the slanted surface 321, thereby pushing the sliding block 3 backward (i.e. the slanted surface 321 moves toward the rear surface 323 of the platform 32). In one embodiment, the slanted surface has a curved shape.

Because the platform 32 is raised above the upper surface of the base 31, when two sliding blocks 3 are coupled together, the lower surface 322 of the platform 32 of one sliding block 3 will move above the upper surface 311 of the base 31 of the other sliding block, as shown in FIGS. 2*b* and 2*c*. To limit the range of motion of the platform 32 relative to the other sliding block 3, a blocking portion extends from the upper surface 311 of the base 31 to contact against the slanted surface 321 of the other sliding block. In one implementation, the blocking portion is a blocking wall 35 facing the rear surface 323 of the platform 32. In another embodiment, the blocking portion may also be a blocking block 36 disposed on a side of the base 31. To cooperate with the blocking block 36, the platform 32 of other sliding block 3 has a notch 37 corresponding in position with the blocking block 36 of the first sliding block 3, such that when the two sliding blocks contact each other, the contact surface 361 of the blocking block 36 of the first sliding block is in contact against the contact surface 371 of the notch 37. In a preferred embodiment, both the blocking wall 35 and the blocking block 36 are employed.

To assemble the two sliding blocks, the platform 32 of one sliding block is disposed above the upper surface 311 of the base 31 of other sliding block. The biasing members such as springs 33 are disposed at an end of the base 31 opposite the end where the platform 32 is located. Various types of springs and various mounting methods may be used. In a preferred embodiment, the spring is a helical torsion spring. Such springs are compact and each to mount and replace. A post 34 is disposed outside of the blocking wall 35 and extends upward from the base 31 and the torsion spring 33 is disposed around the post 34. One leg 332 of the torsion spring 332 is pressed against the blocking wall 35, while the other leg 331 is pressed against an inner surface 13 of the cover 1 when assembled (see FIGS. 5*a*-7*b*). The springs 33 provide the biasing force for the sliding blocks to urge the sliding blocks against each other, such that in a normal state, the lower surface 322 of the platform 32 covers the upper surface 311 of the other sliding block 3. As a result, the shutter is closed and the conductors of the receptacle are not accessible. Also as shown in FIGS. 2*b* and 2*c*, a protrusion 351 is formed on the outside of the blocking wall 35 such that it is located above the leg of the spring 33 that is pressed against the blocking wall to further secure the spring in its place.

In the above-described preferred embodiment, the slanting surfaces 321 face the outside of the sliding blocks 3 such that the rear surfaces 323 of the platform 32 on the two sliding blocks face each other. This allows the sliding blocks to have a greater range of travel, so that even plugs with relatively thick prongs can be plugged into the receptacle, enhancing the applicability of the receptacle. Further, having the two rear surfaces 323 face each other can prevent the sliding blocks from over traveling when oversized prongs are inserted. It also prevents over compression of springs 33.

Figure 3:
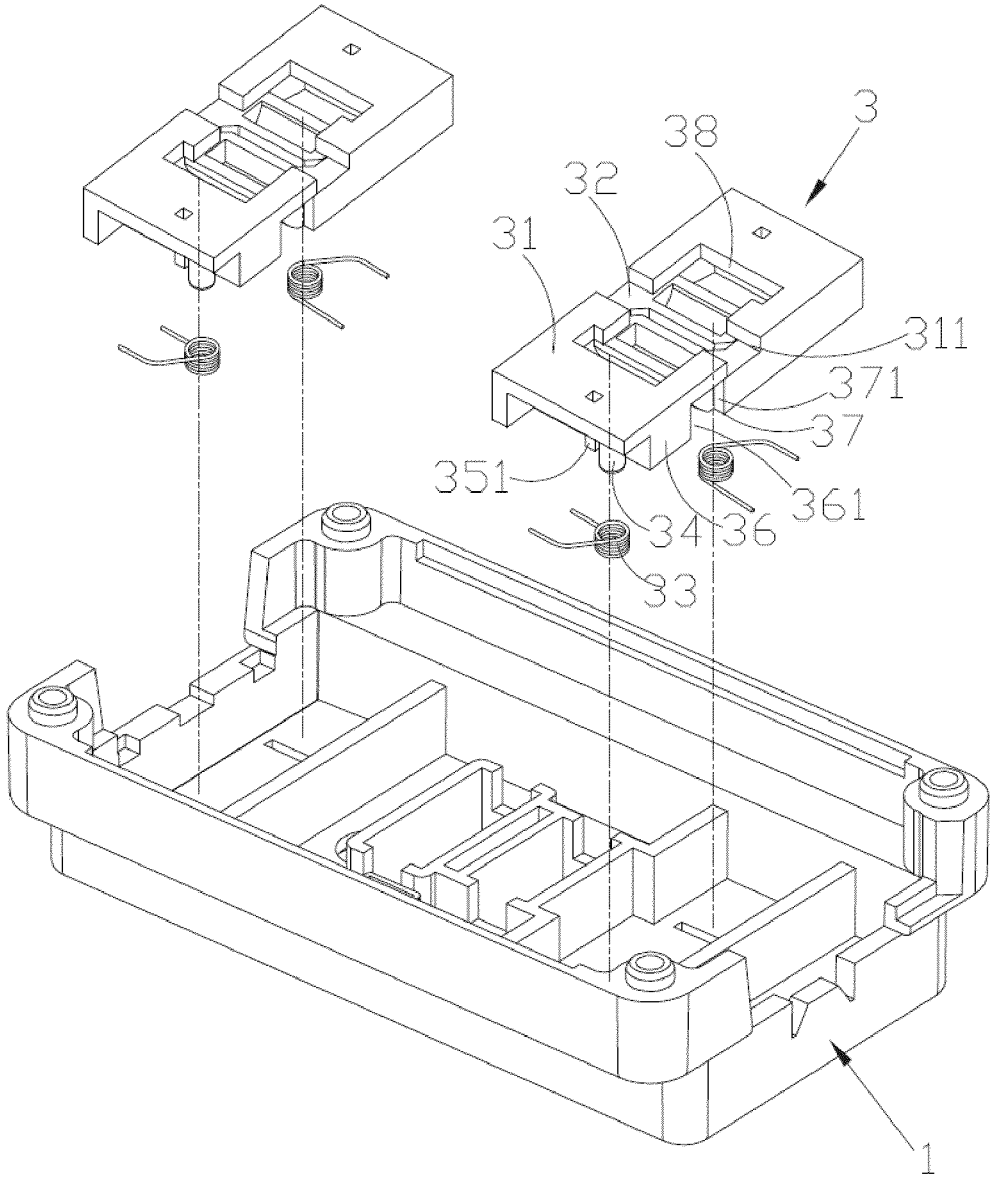
FIG. 3 is a perspective view of the safety shutters of FIG. 1 viewed from a different direction along with the cover of the receptacle.
Figure 4:
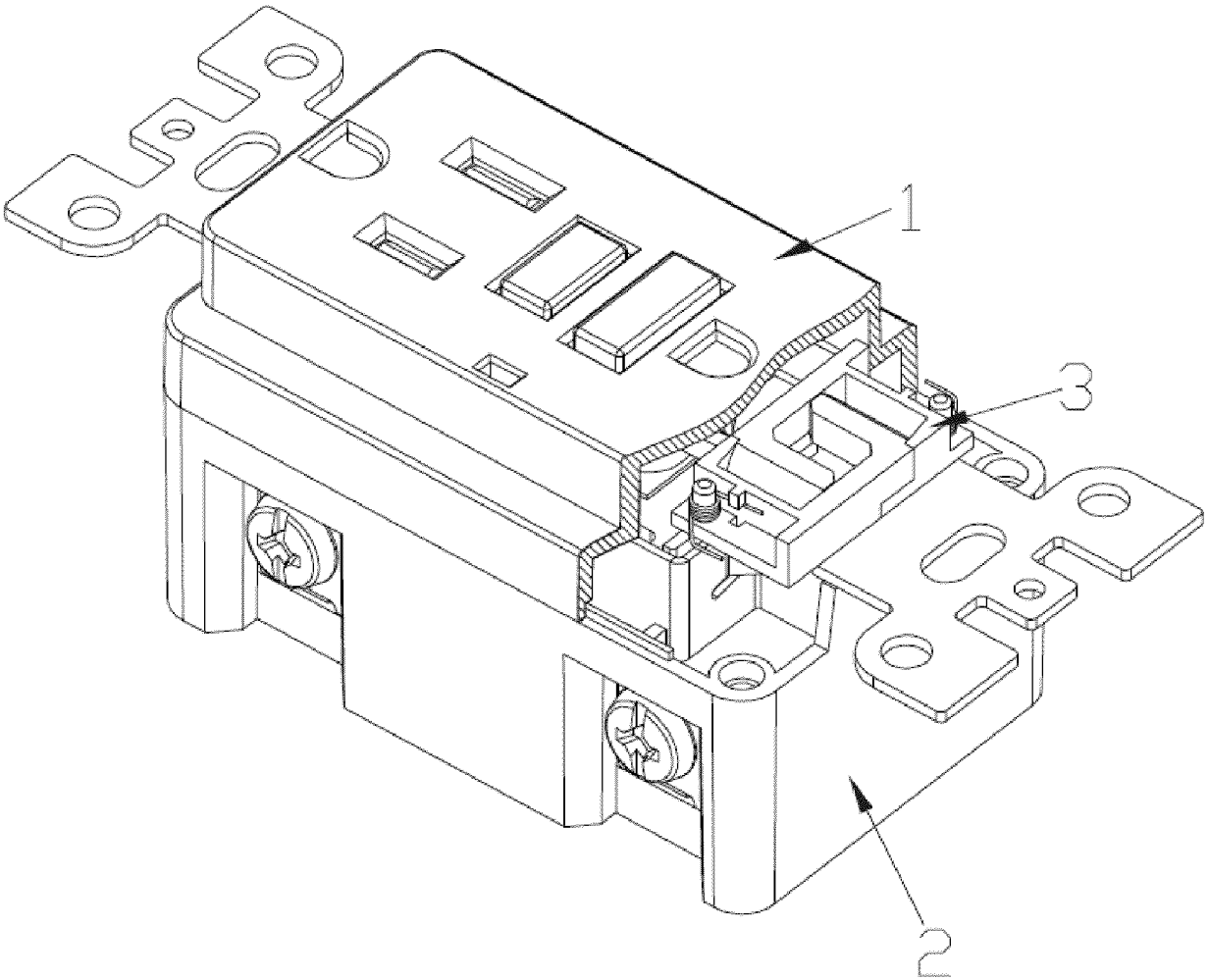
FIG. 4 is a partial cut-away perspective view of the safety shutter installed in the receptacle.

FIG. 3 shows the sliding blocks 3 and the cover 1 from a different perspective than FIGS. 2*a*-2*c*. From FIG. 3, it can be seen that the platform 32 extends upward and outward from the upper surface 311 of the base 31. (Note that the sliding blocks 3 are turned upside-down in FIG. 3 relative to FIGS. 2*a*-2*c*.) It can also be seen that the base 31 having an opening 38 generally has a U shape, so that when the two sliding blocks are assembled, the opening correspond to the hot and neutral holes 11 of the receptacle, and the ground hole 12 does not have a shutter. This can be further seen in FIG. 4. In other words, the safety shutter of this embodiment emphasizes the protection of the hot and neutral holes 11 with a relatively compact and simple structure.

The operation of the safety shutter is explained now with reference to FIGS. 5*a*-7*b*.

Figure 5A:
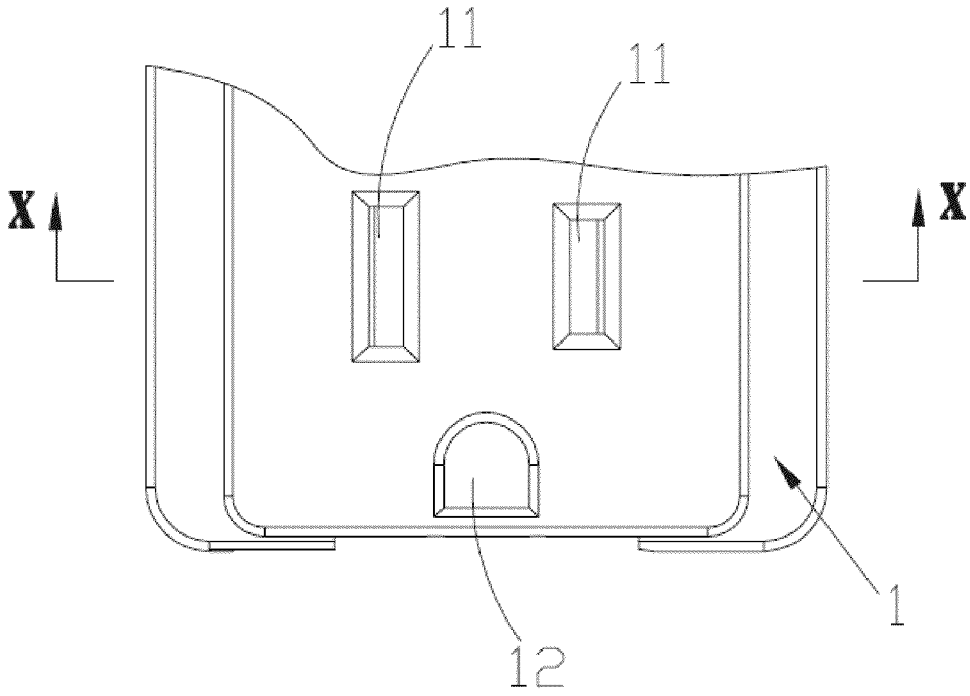
FIGS. 5*a*-5*b* illustrate the tamper resistant receptacle when no object is inserted into the hole, where
Figure 5B:
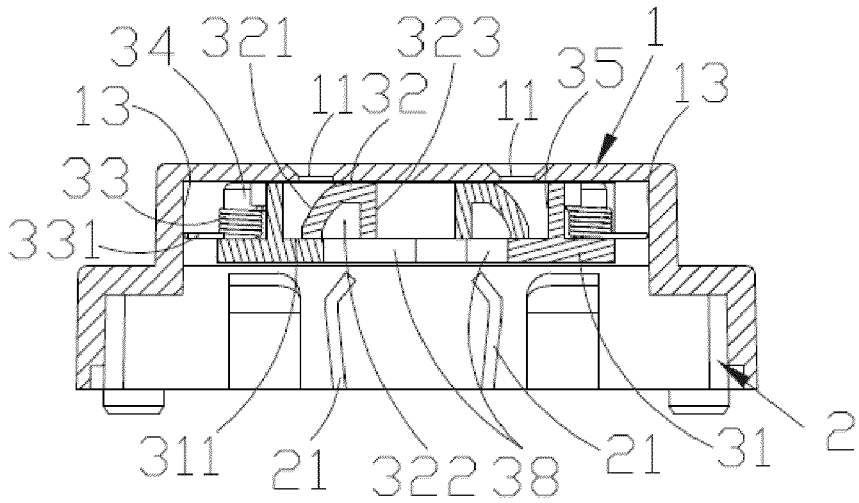

In the normal state, the two sliding blocks are urged by the two springs 33 toward the center to stable positions. In this state, the lower surface 322 of the platform 32 of one sliding block 3 rests on the upper surface 311 of the base 31 of the other sliding block 3, as shown in FIG. 5*b*. Thus, in this state, the conductors inside the receptacle are isolated from the outside environment, minimizing the adverse effects of the environment (dust, moisture, etc.) on the conductors.

Figure 6A:
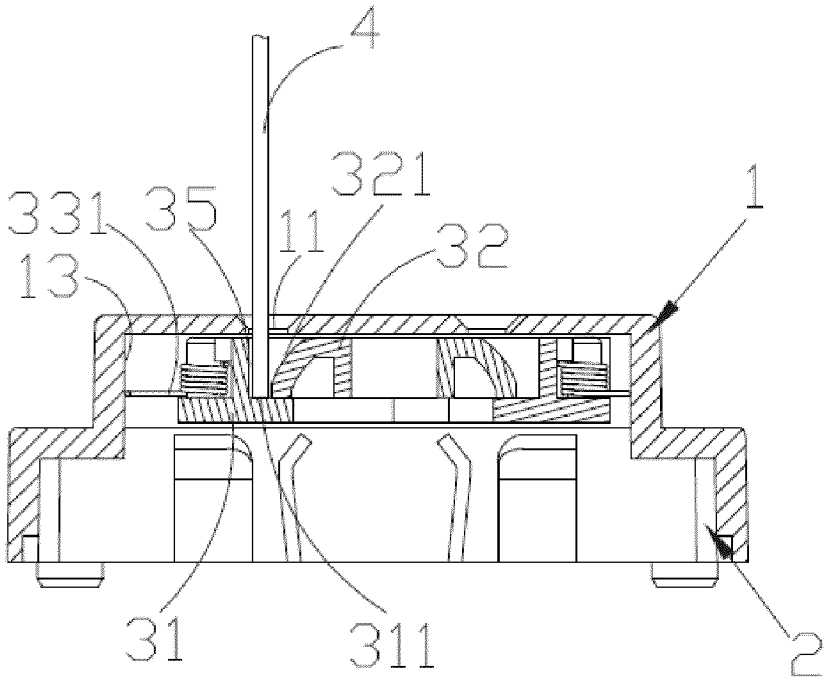
FIGS. 6*a*-6*b* are cross-sectional views illustrating the tamper resistant receptacle when an object is inserted into a single hole.
Figure 6B:
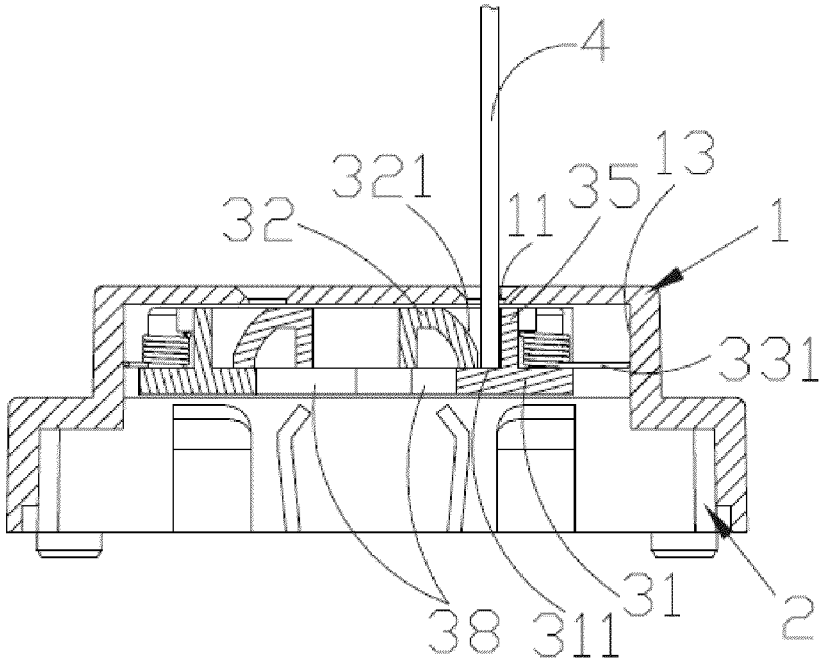

When a foreign object 4 such as a metal wire, nail, a child's finger, etc. is inserted into a single hole of the receptacle, as shown in FIGS. 6*a* and 6*b*, the foreign object 4 slides downward along the slanted surface 321 of the platform 32 of the first sliding block 31 below that hole 11. This pushes the platform 32 toward the center, increasing the torsion on the spring 33 for the first sliding block 3. However, the blocking wall 35 of the second sliding block 3 is urged by its spring 33 and moves in the same direction as the platform 32 of the first sliding block, so that the lower surface 322 of the platform 32 of the first sliding block 3 is always positioned above the upper surface 311 of the base 31 of the second sliding block 3. As a result, the foreign object 4 cannot reach the conductors 21, effectively preventing electrical shock.

Figure 7A:
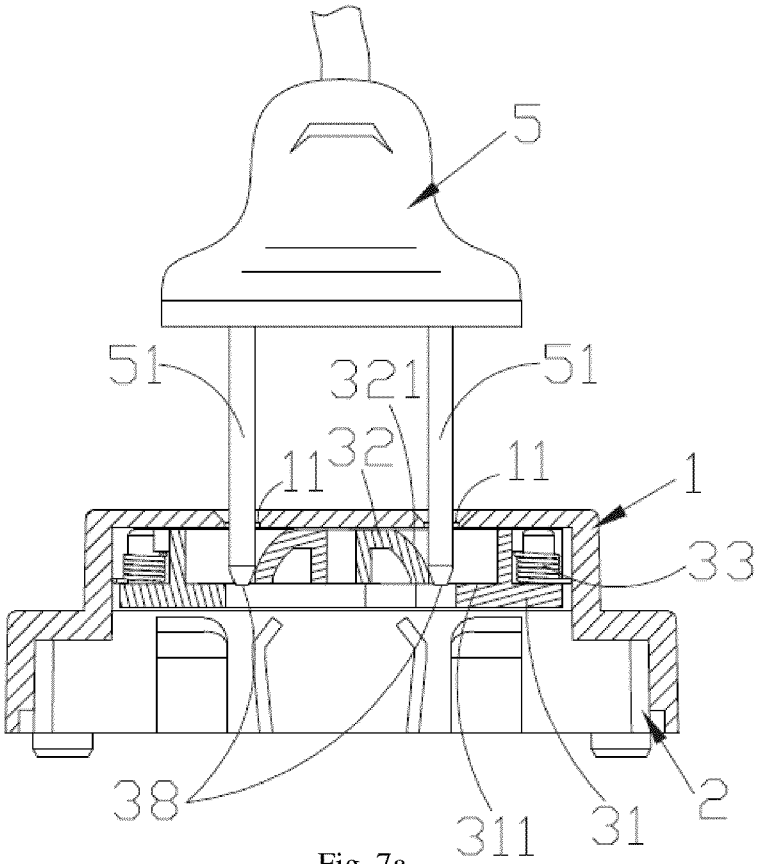
FIGS. 7*a*-7*b* are cross-sectional views illustrating the tamper resistant receptacle when a plug is correctly inserted into the receptacle.
Figure 7B:
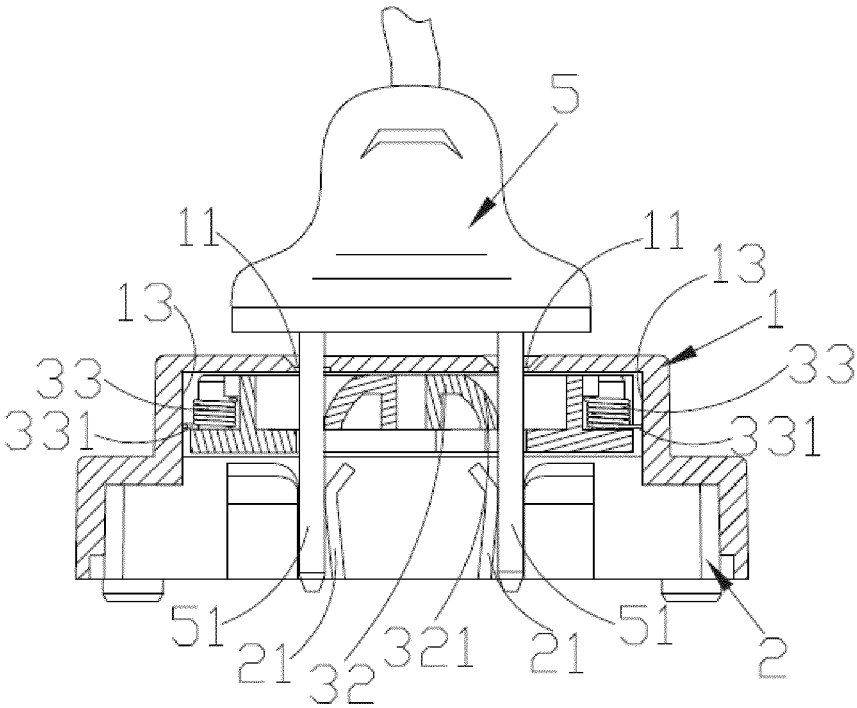

The normal operation of the receptacle is shown in FIGS. 7*a* and 7*b*. When a plug 5 is properly inserted, i.e. the two prongs 51 are inserted simultaneously, and move down along the slanted surfaces 321 on both sliding blocks. The sliding blocks 3 move toward each other against the bias of the springs 33, such that the lower surface 322 of one block no longer overlaps the upper surface 311 of the base 31 of the other sliding block. Thus, the opening 38 of the sliding blocks are exposed, allowing the prongs 51 to reach the conductors 21 to establish an electrical connection. Moreover, because the blocking walls 35 are urged by the springs 33 to return to the closed position, it makes the prongs 51 more securely inserted in the receptacle.

Figure 8A:
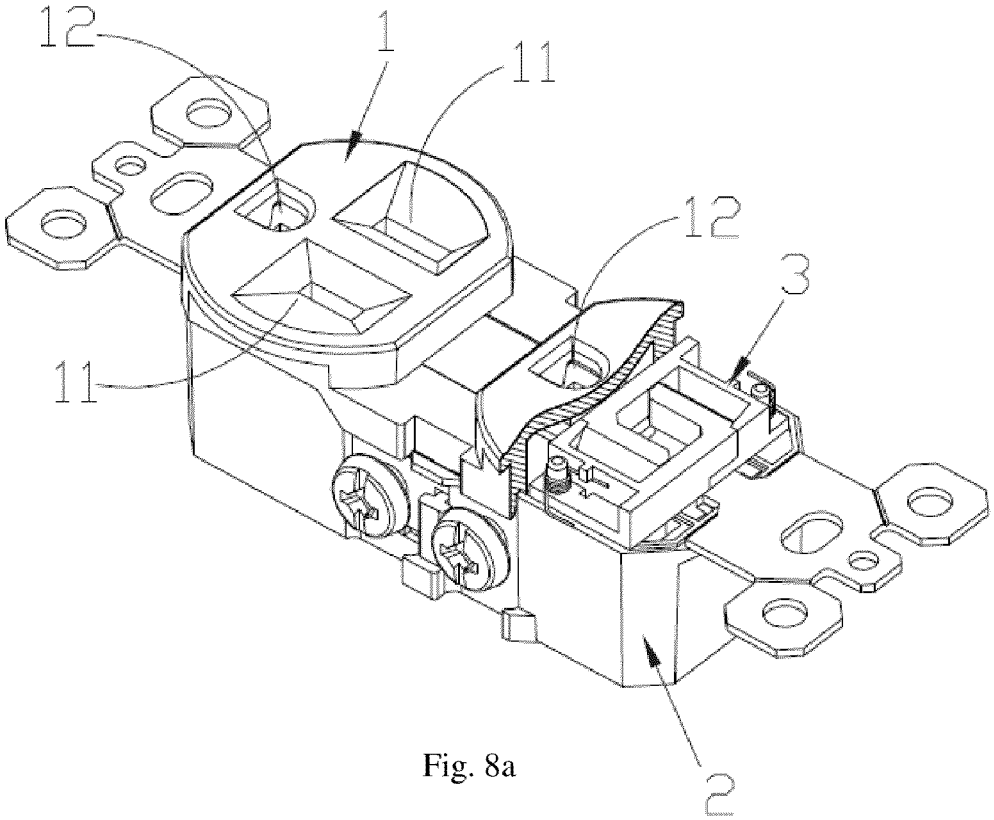
FIGS. 8*a*-8*c* illustrate tamper resistant receptacle according to other embodiments of the present invention.
Figure 8B:
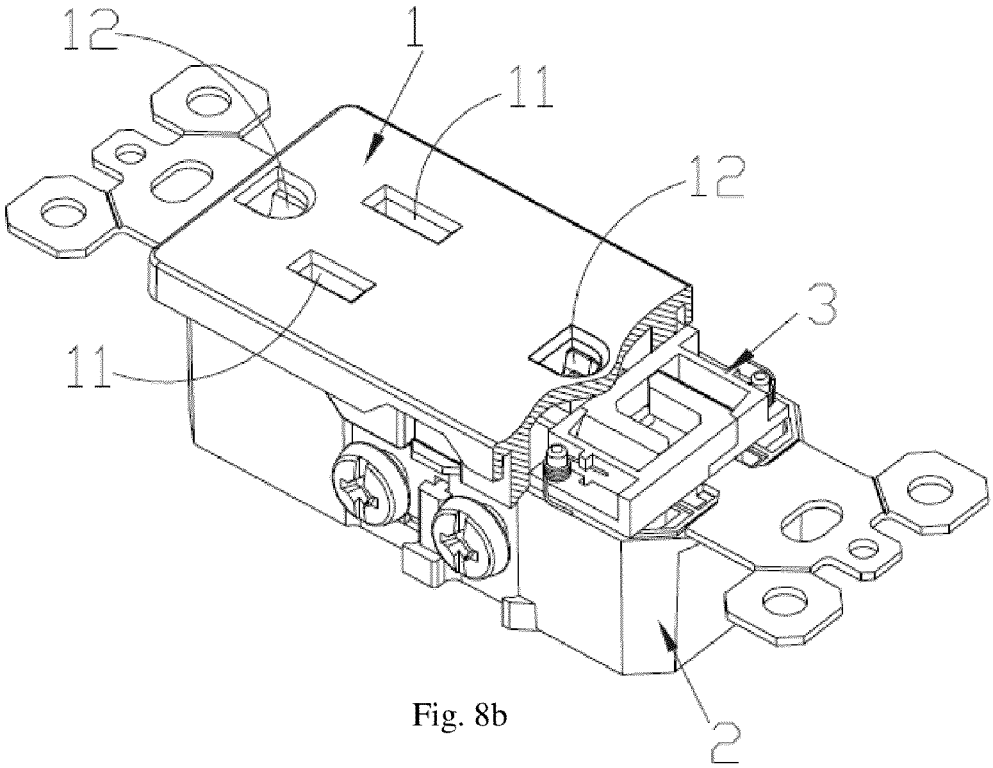
Figure 8C:
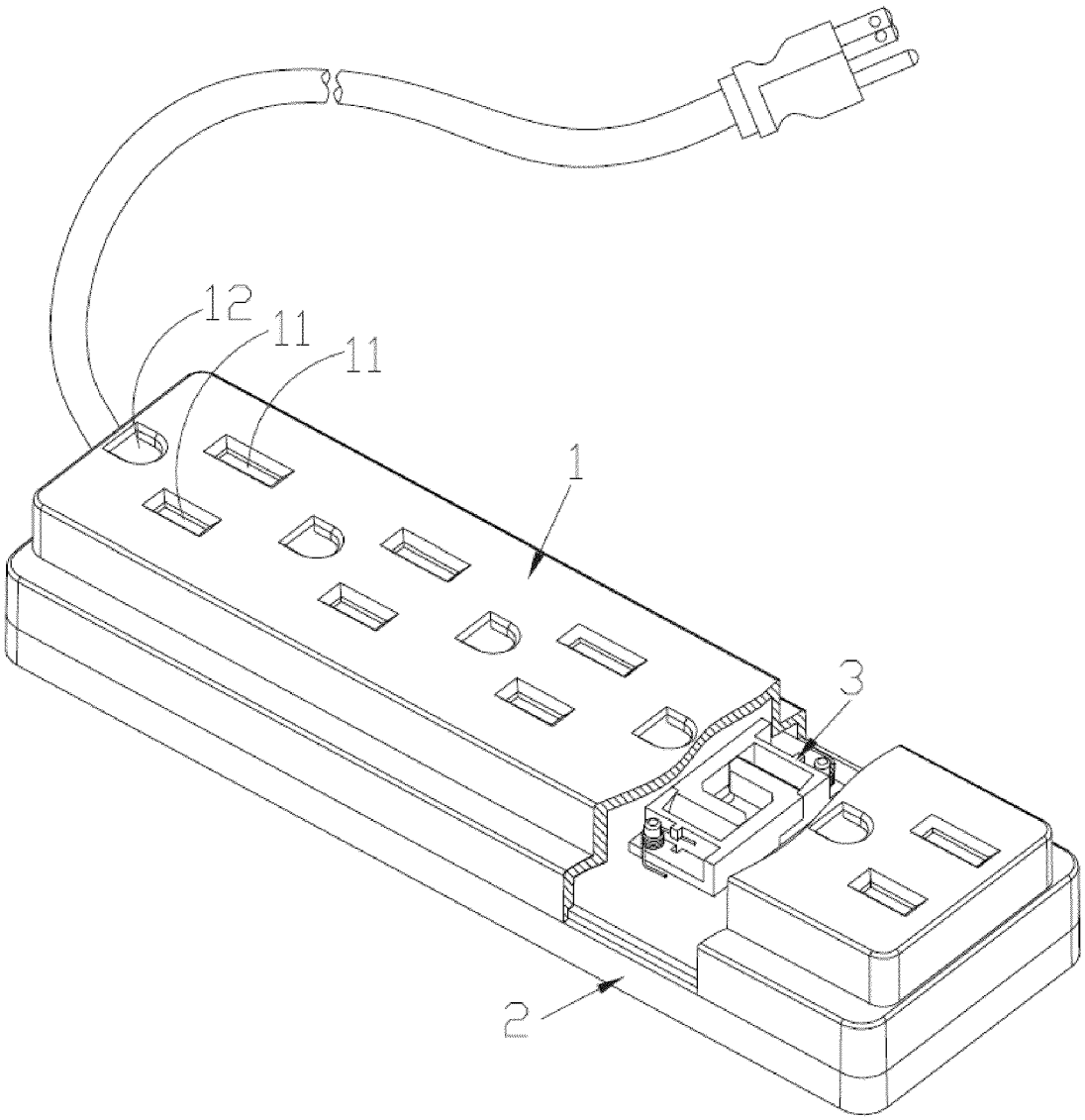

FIGS. 8*a*-8*c* show several receptacles incorporating the safety shutter according to embodiments of the present invention. As seen in these figures, the structures of the hot and neutral holes and the ground hole may be varied according to the practical applications, and the receptacle maybe a wall mounted receptacle or a receptacle on an extension cord, while the structures of the safety shutter may be used regardless of these variations. Due to the compact structures of the safety shutter, the overall size of the receptacle is not substantially increased. For these reasons, the receptacle has wide applications.

It will be apparent to those skilled in the art that various modification and variations can be made in the power receptacle of the present invention without departing from the spirit or scope of the invention. Thus, it is intended that the present invention cover modifications and variations that come within the scope of the appended claims and their equivalents.

What is claimed is:

1. A safety shutter for a power receptacle, comprising:

two identical sliding blocks engaged with each other, wherein each sliding block includes a base having an opening and a platform extending upward and outward from a first end of the base, the platform having an outward-facing slanted surface and a rear surface opposite the slanted surface, wherein the rear surfaces of the two platforms face each other, wherein the platform of each sliding block is disposed above an upper surface of the base of the other sliding block, and wherein each sliding block has a blocking portion extending from the base to contact against the slanted surface of the other sliding block when the two sliding blocks move relative to each other in a first direction; and two helical torsion springs, one for each sliding block, wherein each helical torsion spring is disposed at a second end of the corresponding sliding block to urge the two sliding blocks to move relative to each other in the first direction.

2. The safety shutter of claim 1, wherein the blocking portion of each sliding block includes a blocking wall disposed at the second end of the sliding block, wherein one leg of the helical torsion spring is disposed against the blocking wall.

3. The safety shutter of claim 1, wherein the blocking portion of each sliding block includes a blocking block disposed on one side of the base sliding block, and wherein the platform of each sliding block has a notch corresponding in position with the blocking block of the other sliding block.

4. The safety shutter of claim 1, wherein the slanted surface has a curved shape.

5. A tamper resistant power receptacle, comprising:

a cover having at least two holes;

a base coupled to the cover, the base including a plurality of conductors corresponding in position with the holes of the cover; and a safety shutter which includes:

two identical sliding blocks engaged with each other, wherein each sliding block includes a base having an opening and a platform extending upward and outward from a first end of the base, the platform having an outward-facing slanted surface and a rear surface opposite the slanted surface, wherein the rear surfaces of the two platforms face each other, wherein the platform of each sliding block is disposed above an upper surface of the base of the other sliding block, and wherein each sliding block has a blocking portion extending from the base to contact against the slanted surface of the other sliding block when the two sliding blocks move relative to each other in a first direction, and wherein the slanted surfaces of the two sliding blocks are disposed below the two holes of the cover; and two helical torsion springs, one for each sliding block, wherein each helical torsion spring is disposed at a second end of the corresponding sliding block to urge the two sliding blocks to move relative to each other in the first direction.

6. The tamper resistant power receptacle of claim 5, wherein the blocking portion of each sliding block includes a blocking wall disposed at the second end of the sliding block, wherein one leg of the helical torsion spring is disposed against the blocking wall.

7. The tamper resistant power receptacle of claim 5, wherein the blocking portion of each sliding block includes a blocking block disposed on one side of the base sliding block, and wherein the platform of each sliding block has a notch corresponding in position with the blocking block of the other sliding block.

8. The tamper resistant power receptacle of claim 5, wherein the slanted surface has a curved shape.

* * * * *